US007448985B2

(12) United States Patent
Basyuk

(10) Patent No.: US 7,448,985 B2
(45) Date of Patent: Nov. 11, 2008

(54) EXERCISE AND MASSAGE DEVICE

(76) Inventor: Simon Basyuk, 436 Milburn Ave., Millburn, NJ (US) 07041

( * ) Notice: Subject to any disclaimer, the term of this patent is extended or adjusted under 35 U.S.C. 154(b) by 0 days.

(21) Appl. No.: 11/805,619

(22) Filed: May 23, 2007

(65) Prior Publication Data

US 2007/0225125 A1 Sep. 27, 2007

Related U.S. Application Data

(62) Division of application No. 10/637,435, filed on Aug. 8, 2003, now Pat. No. 7,223,207.

(60) Provisional application No. 60/410,194, filed on Sep. 13, 2002.

(51) Int. Cl.
*A63B 23/16* (2006.01)
*A63B 21/012* (2006.01)

(52) U.S. Cl. ..... 482/44; 482/49; 482/114

(58) Field of Classification Search ..... 482/44–50; 446/124–126, 119–121; 434/211–214; 132/242
See application file for complete search history.

(56) References Cited

U.S. PATENT DOCUMENTS 2,423,420 A * 7/1947 Talbot ..... 132/242
3,122,146 A * 2/1964 Safianoff ..... 132/245
4,234,001 A * 11/1980 Morefield ..... 132/251
4,538,806 A * 9/1985 Wilkerson ..... 482/108
4,775,349 A * 10/1988 Short et al. ..... 446/107
4,830,364 A * 5/1989 Wexler ..... 482/148
5,299,991 A 4/1994 Sato
5,318,470 A * 6/1994 Denny ..... 446/126
5,533,949 A * 7/1996 Hwang ..... 482/47
5,727,947 A * 3/1998 Esterle ..... 434/258
5,785,529 A * 7/1998 Hearn et al. ..... 434/211
5,857,892 A * 1/1999 Leadbetter ..... 446/431
6,007,460 A * 12/1999 Young ..... 482/49
6,241,637 B1 * 6/2001 Basyuk ..... 482/44
6,461,276 B1 * 10/2002 Yu ..... 482/44
6,514,179 B1 * 2/2003 Yu ..... 482/44
6,527,675 B1 * 3/2003 Yu ..... 482/44
6,641,453 B1 * 11/2003 Morales et al. ..... 446/126
7,223,207 B1 5/2007 Basyuk

* cited by examiner

*Primary Examiner*—Fenn C Mathew
(74) *Attorney, Agent, or Firm*—Lawrence G. Fridman

(57) ABSTRACT

An exercise device includes a housing having at least a wall portion, at least two apertures extending through the wall portion and spaced from each other, and at least one elongate rod having a center section located between opposite ends. The center section is adapted for slidable movement through the apertures. The friction generating arrangement provides frictional engagement of the elongate rod with the apertures, so as to resist sliding movement of the rod through the apertures.

12 Claims, 7 Drawing Sheets

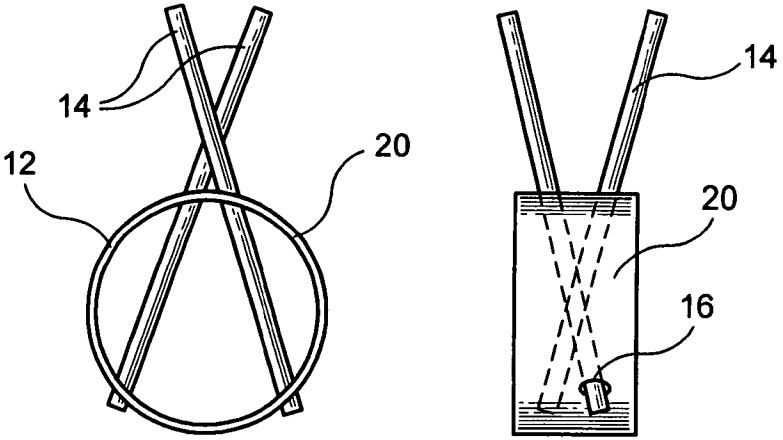
FIG. 26
FIG. 27
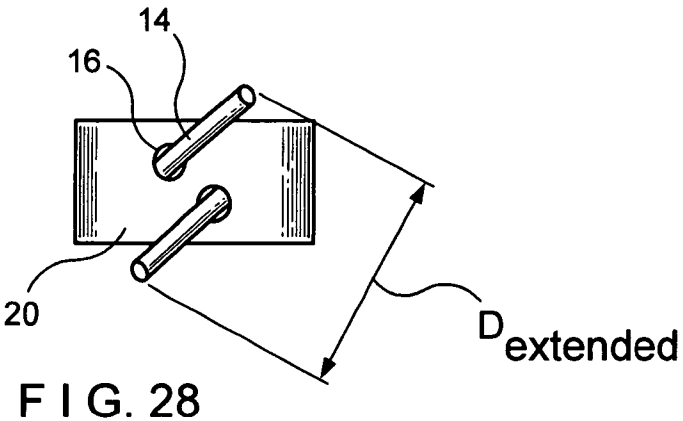
FIG. 28
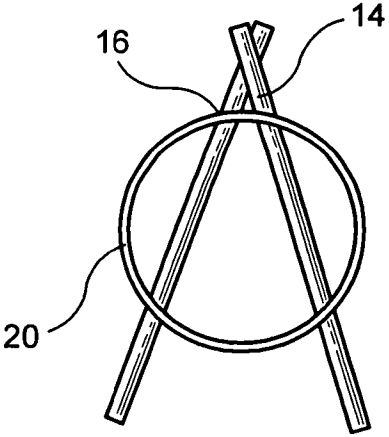
FIG. 29
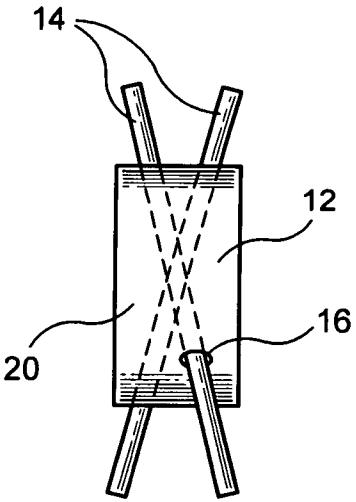
FIG. 30
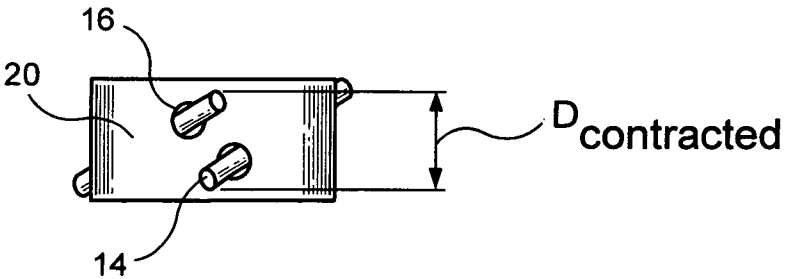
FIG. 31

EXERCISE AND MASSAGE DEVICE

CROSS REFERENCE TO RELATED APPLICATIONS

This application is the Divisional of the patent application Ser. No. 10/637,435 filed Aug. 8, 2003 now U.S. Pat. No. 7,223,207 which claims the benefit under 35 U.S.C. 119 (e) of U.S. Provisional Application No. 60/410,194 filed by Simon Basyuk on Sep. 13, 2002.

BACKGROUND OF THE INVENTION

1. Field of the Invention

This invention relates to exercise and therapeutic devices and more particularly, it relates to the devices for stress relief and developing of muscles associated with hands, fingers, etc.

2. Description of the Related Art

Persons afflicted with many infirm conditions often lack the considerable hand and finger strength required to perform often basic functions associated with everyday living. For example, weak finger muscles, as well as other physical conditions, may be resulted in the difficulty grasping, manipulating objects and generating a pincer grip by elderly or infirm. For example, people suffering from deteriorating tissue or muscles of the fingers or palm may be unable to grasp and manipulate many basic implements without incurring debilitating pain. These medical conditions may also adversely affect a person's ability to perform rotational and similar functions. This is particularly troublesome to a person whose hands have been disabled by arthritis, multiple sclerosis, muscular dystrophy, and other disabilities. Furthermore, many elderly individuals also have limited hand dexterity further contributing to the difficulty in holding and/or grasping objects. Such limited hand dexterity also leads to reduced ability of such individuals to pick up, manipulate and exert force on various implements and objects.

It is well known that physical exercise can improve the condition of such individuals through the developing of the muscles of fingers and hands, so as to improve the ability to hold, grasp and manipulate the implements and objects and to enhance the pincer grip.

Today, many physical therapy facilities, fitness centers, etc. are provided with exercising machines adapted to improve general physical condition of a human body. Despite the wide range of equipment and programs, exercise devices for development of the hands, fingers and palms have been largely neglected. It is notable that, despite the many expensive exercise devices, it is difficult to find equipment for increasing the strength and flexibility of the hands, fingers, etc. This is especially related to those devices which are light in weight and efficient for use by many individuals including elderly and infirm. This is in spite of the fact that such equipment is important for maintaining the essential living functions by many individuals. Even when available, however, the development and implementation of exercise devices for the hands and fingers has lagged in comparison to other exercise devices.

The hand exercising devices of the prior art generally suffer from one or more drawbacks and limitations that oftentimes render them undesirable or unsuitable for use by elderly or infirm or by others in hand muscle exercises. Generally, these drawbacks and limitations stem from the device structure. By way of example, U.S. Pat. No. 5,299,991 to Sato discloses a finger training device incorporating a relatively complex mechanical structure. U.S. Pat. No. 6,007,460 to Yunk provides a hand exercise device adapted for use by athletes in which a substantial force exerted by four fingers of one hand is required in order to overcome a substantial force generated by the resilient element. In many instances this device is not completely suitable for use in therapeutic purposes. U.S. Pat. No. 5,533,949 provides a hand-muscle developing device with music producing means which is clearly complicated, expensive in manufacturing and not always suitable for use by the elderly or infirm. Even more sophisticated devices including the inventors' own hand exercise device disclosed by U.S. Pat. No. 6,241,637 provide a hand exercise device adaptable for use by athletes or others requiring development of hand or finger strength as a part of physical exercise and not necessarily adapted for use by individuals afflicted by infirm conditions.

Thus, it has been long felt and unsolved need to provide a light, simple and reliable hand exercise device having uniform application and adaptable for use by elderly, infirm as well as by other individuals requiring development of hand and finger muscles and joints.

SUMMARY OF THE INVENTION

One aspect of the invention provides an exercise device having a housing with at least a wall portion, at least two apertures extending through the wall portion and spaced from each other and at least one elongate rod having a center section. The center section being adapted for slidable movement through the apertures. A friction generating arrangement provides frictional engagement of the at least one rod with the apertures to thereby resist slidable movement of the rod through these apertures.

As to another aspect of the invention, the housing is formed having a substantially hollow configuration, wherein at least one elongate rod comprises at least two elongate rods, at least two apertures comprise at least two pairs of apertures and each elongate rod being slidably received within the respective apertures. The wall portion, two pairs of apertures and two elongate rods are arranged in such a manner that the elongate rods apply pressure on each other resulted in frictional engagement of the elongate rods with each other and with the apertures, so as to resist sliding movement of the rods within the apertures. The elongate rods can be positioned at an angle to a plane perpendicular to a longitudinal axis of the housing.

As to a further aspect of the invention, the wall portion is formed of a resilient material and an outer periphery of at least one aperture is deformed so as to provide resistance to the slidable movement of a rod. The rod can be positioned at an angle to an axis passing through a plane of the aperture prior to insertion of the rod therethrough.

As to another aspect of the invention, the friction generating arrangement includes a biasing member extending longitudinally within the housing, so as to exert pressure on the elongate rod. The friction generating arrangement can be in the form of a resilient member interposed between a bottom portion of a housing and at least one elongate rod.

As to a still further aspect of the invention, the friction generating arrangement can be formed as an elongated, resilient friction generating member longitudinally extending within the housing, so as to engage and exert pressure on the rod and to provide resistance to slidable movement of the rod within the respective apertures.

In yet another embodiment of the invention, an insert is provided operationally associated with the housing and adapted to provide resistance to slidable motion of the rod. The insert is formed with at least one pair of openings corresponding to the respective pair of apertures. Each opening can be formed with a frictional member extending toward a central area thereof, so as to provide additional resistance to the slidable motion of the rod. A plurality of slots can be provided extending between each opening and one of top or bottom regions of the insert.

BRIEF DESCRIPTION OF DRAWINGS

The preferred embodiments of the invention will hereinafter be described in conjunction with the appended drawings provided to illustrate and not to limit the invention, where like designations denote like elements, and in which:

FIGS. 26, 27 and 28 are front, left-hand end and top plan views of the invention, respectively, with two rods in the extracted position;

FIGS. 29, 30 and 31 are front, left-hand end and top plan views of the invention, respectively, with two rods in the contracted position;

DETAILED DESCRIPTION OF THE PREFERRED EMBODIMENT

Figure 1:
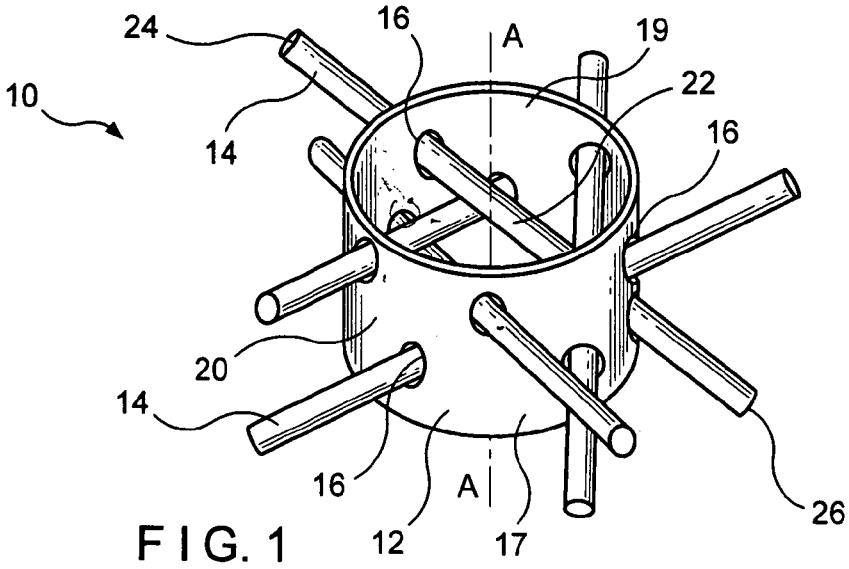
FIG. 1 is a perspective view of the device according to one embodiment of the invention.
Figure 2:
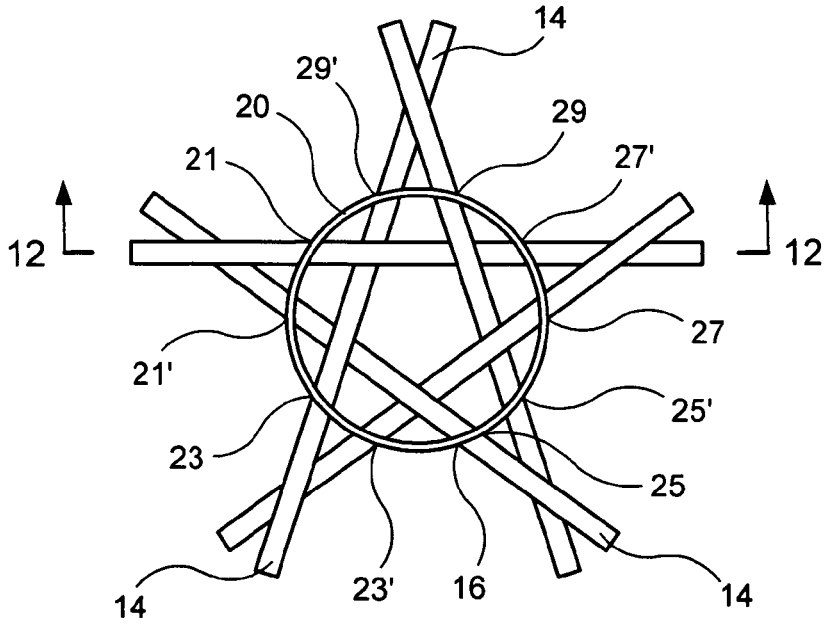
FIG. 2 is a top plan view of the device shown in FIG. 1.

Referring now to the drawings, and to FIGS. 1 and 2 in particular, a hand exercise device 10 according to a first embodiment of the invention comprises a housing 12, a plurality of exercise rods 14 adapted for slidable motion within the respective operational apertures 16 formed in the housing 12. The housing is preferably molded into a cylinder having a substantially hollow interior and is sized to fit comfortably in the hand of a user. A plurality of operational apertures 16 are formed with a wall 20 of the housing so as to extend between an outer surface 17 and an inner surface 19 of the wall. The housing may be constructed of a plastic material that is capable of retaining its original shape and resistant to deformation from forces applied by a user's hand. It is to be understood, of course, that the housing may be formed of any suitable material that is capable of retaining its shape, and may be formed into any desired configuration. Number and location of the apertures will be described further.

Figure 8:
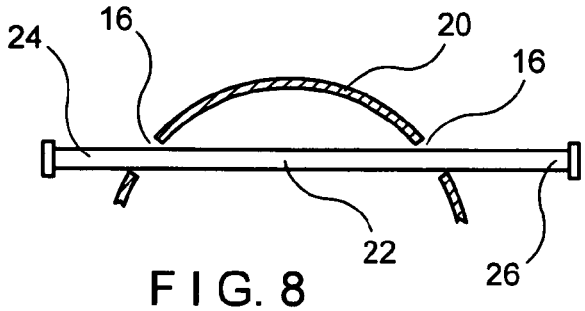
FIG. 8 is a cross-sectional view showing another embodiment of the rod.
Figure 9:
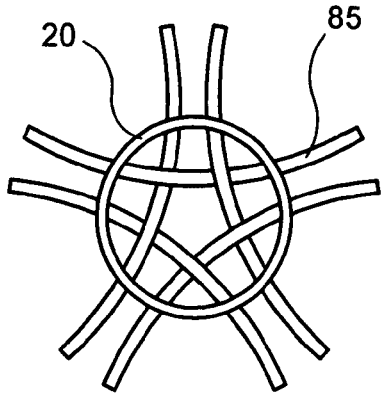
FIG. 9 is a top plan view of the device having curved rods.

Each exercise rod 14 includes an elongate center section 22 that is preferably formed having a substantially cylindrical configuration and extends between two end sections 24 and 26. In the preferred embodiment of the invention each rod 14 is slidably supported by a pair of operational apertures 16. Preferably, the center section and end sections have the same cross-section. In another embodiment of the rod illustrated in FIG. 8, the end sections 24 and 26 are formed with enlargements having greater diameter than the diameter of the respective operational apertures 16, so as to prevent separation of the rods from the housing. In another embodiment of the rod the enlargement can be located in the middle part of rod. Moreover, although the substantially cylindrical center section of the rod has been described hereinabove, the center section may be of any suitable cross-section, for example oval, as long as it facilitates slidable motion thereof with the operational apertures. Yet another embodiment showing curved-shaped rods 85 is illustrated in FIG. 9.

Figure 3:
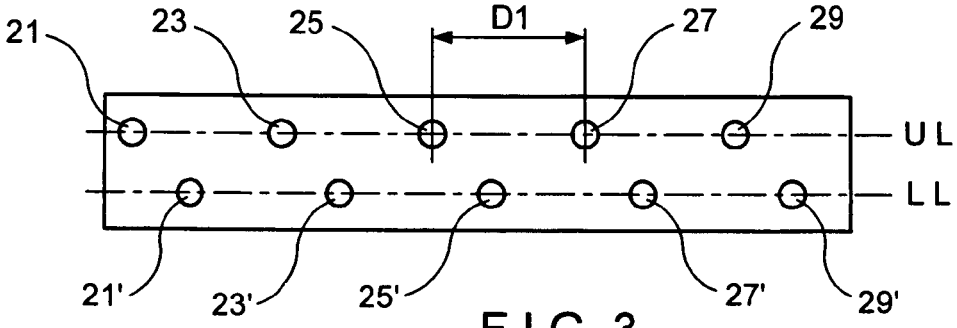
FIG. 3 shows a wall element of the device shown in FIG. 1 in flat condition.

Although any reasonable number of apertures may be formed at different locations of the wall element 20, in the embodiment of FIGS. 1, 2 and 3 the housing is formed with ten operational apertures provided in the substantially cylindrical wall element. The apertures are typically located at two levels of the wall element, so as to be separated by the predetermined intervals DI. In this manner, apertures 21, 23, 25, 27 and 29 are provided at the upper level UL and apertures 21', 23', 25', 27', and 29' are formed at the lower level LL (see FIGS. 2 and 3). Each of five rods is slidably supported by a pair of apertures, wherein one aperture of each pair is located at the upper level and other at the lower level. These pairs of apertures are selected in a consequential order. By way of example, a first rod extends through apertures 25 and 21', a second rod through apertures 23 and 29', a third rod through apertures 21 and 27', a fourth rod through apertures 29 and 25', and a fifth rod through apertures 27 and 23'. In this manner each rod has the same inclination relatively to the plane perpendicular to the axis of cylindrical wall element. For a pair of adjacent rods, one rode is not parallel to another. On a top plan view, the combination of rods resembles a star with five rays, as illustrated in FIG. 2.

Figure 5:
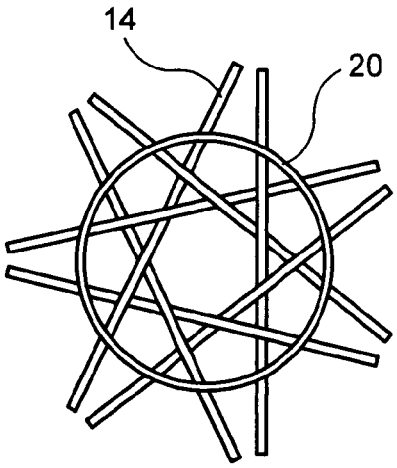
FIG. 5 illustrates an embodiment of the device utilizing seven rods.

FIG. 5 illustrates the device of the invention formed with substantially cylindrical wall element 20 provided with fourteen operational apertures adapted to slidably receive seven rods 14. As illustrated in this figure, the combination of the rods of this embodiment in the top plan view of the device resembles a seven-ray star.

Figure 6:
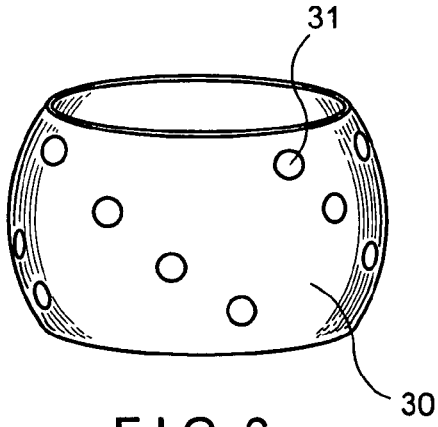
FIG. 6 is a side elevational view of the device having housing formed as a truncated spheroid.
Figure 7:
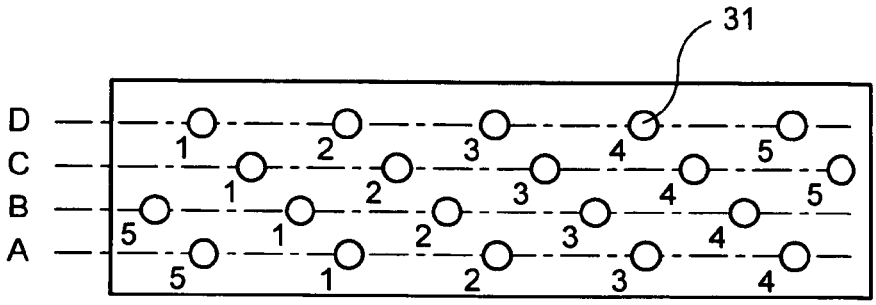
FIG. 7 schematically shows a wall element of the device depicted in FIG. 6 in flat condition.
Figure 10:
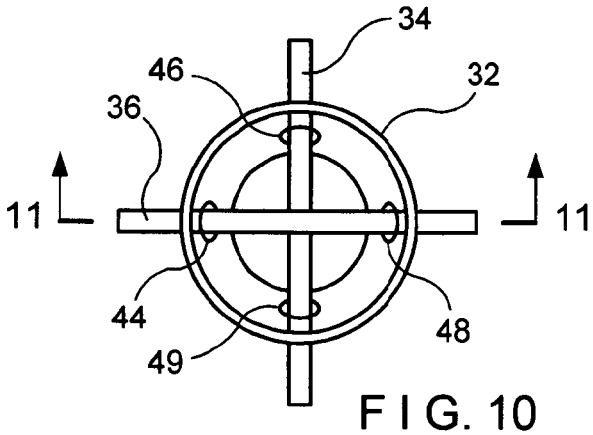
FIG. 10 illustrates one embodiment of the friction-generating arrangement.
Figure 11:
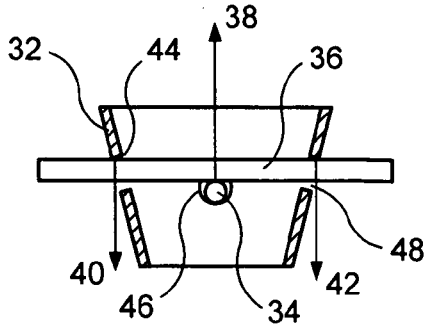
FIG. 11 is a cross-sectional view taken along line 11-11 of FIG. 10

The previous embodiments has been described with the housing having a substantially cylindrical wall element. However, it is to be understood that any configuration of the housing capable of being conveniently handled by a hand of the user is within the scope of the invention. In this respect, FIG. 6 illustrates a housing 30 configured as a truncated substantially hollow spheroid. As illustrated in FIGS. 6 and 7, the housing is provided with twenty operational apertures 31 located at four levels A, B, C and D, with five apertures arranged at each level. This housing is capable of accommodating ten rods extending through the following ten pairs of apertures: A5-D3, A1-D4, A2-D5, A3-D1, A4-D2 and B5-C2, B1-C3, B2-C4, B3-C5 and B4-C1. A housing with twenty apertures located at comers of imaginary dodecahedron encircled into hollow spherical housing is also contemplated. In FIGS. 10 and 11 the housing 32 is shaped as truncated cone.

Significantly, the exercising and stress relief capabilities of the device can be achieved by providing a resistance to the slidable motion of rods within the respective operational apertures. To achieve this function the device of the invention is provided with a friction-generating arrangement. A preferred embodiment of such arrangement is illustrated in FIGS. 10 and 11. Four apertures 44, 46, 48 and 49 are formed in the substantially hollow housing 32 with two identical cylindrical rods 34 and 36 being adapted for slidable motion through the apertures. The apertures are substantially circular in shape and their diameter is slightly greater than diameter of the rods. In this arrangement correlation between relative location of the apertures and diameters of the rods is such that in the assembled condition there is a light interference and/or engagement between the adjacent rods resulted in the pressure exerted by the rods on each other. Such pressure illustrated by the vector 38 causes reactive forces illustrated by the vectors 40 and 42 in areas of contact between the rod 36 and the apertures 44, 48. Upon slidable motion of the rod 36 within the apertures 44, 48, friction occurs between the rod and the respective edges of apertures resulted from the forces 40 and 42. Additionally to that friction, there is also friction between the rods 34 and 36 themselves resulted from force 38. The frictional forces produce required resistance to the slidable movement of the rods within the operational apertures. It is to be understood that the housing for this embodiment can be of any reasonable shape.

Figure 12:
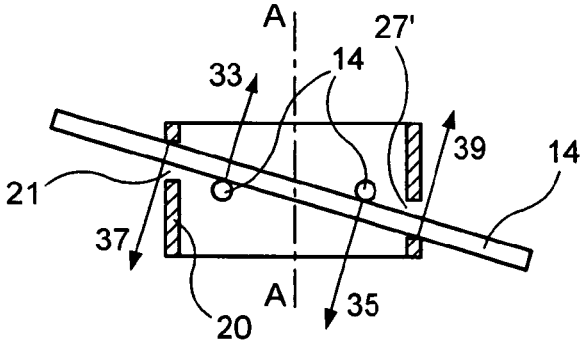
FIG. 12 is a cross-sectional view taken along section line 12-12 of FIG. 2

In the embodiments having multiple pairs of rods illustrated in FIGS. 1, 2, 5 and 6, the friction-generating arrangement is similar to that described with respect to FIGS. 10 and 11. In these embodiments the rods are also formed having substantially cylindrical configuration adapted for slidable cooperation with substantially circular operational apertures. Relative location of all apertures and diameter of the rods are such that there is light interference and/or engagement between the adjacent rods resulted in the pressure exerted by the rods on each other. As illustrated in FIG. 12, the rod 14 is slidably supported by the apertures 21 and 27' and is positioned at an angle to a plane passing through a longitudinal axis A-A of the housing 12 and/or the device 10. Two other adjacent rods exert pressure on the rod 14, where one of such rods is supported by the apertures 23 and 29' and another rod is supported by the apertures 29 and 25' (see FIG. 2). These two adjacent rods are also inclined with respect to the plane perpendicular to a longitudinal axis of the housing and/or device. The forces resulted from the pressure applied by the rods on each other are illustrated by the vectors 33 and 35. These forces generate reactive forces illustrated by the vectors 37 and 39 which occur in areas of contact of the rod 14 with apertures 21 and 27' causing in turn friction between the rods and edges of apertures which support the rods. In the same manner, each of the rods of the star-like rod arrangement is subjected to pressure from two adjacent rods. As in the previously described embodiment, resistance to the slidable movement of the rods within the operational apertures is resulted from friction between rods and edges of the respective apertures and also from the engagement between rods themselves. It is to be understood that the number of the rods and apertures, location of apertures and shape of the housing can vary.

Figure 14:
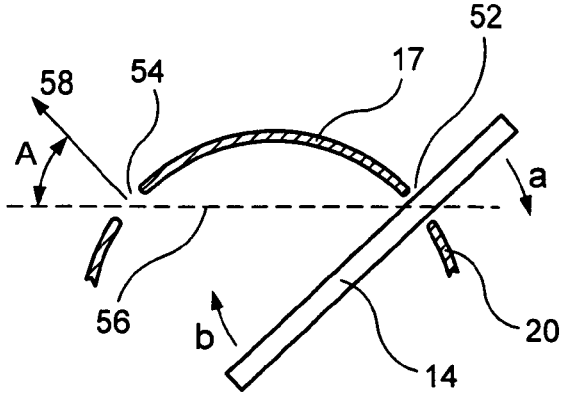
FIG. 14 is a cross-sectional view of a wall element and a rod before being positioned as illustrated in FIG. 13.
Figure 13:
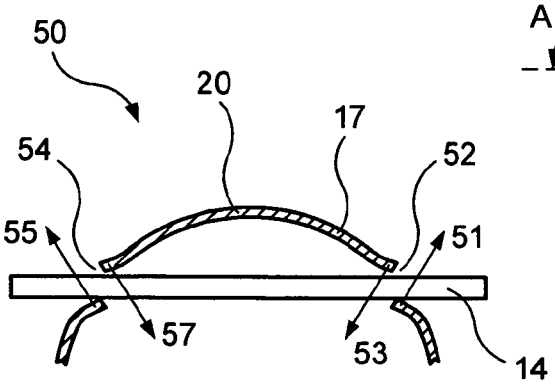
FIG. 13 is a cross-sectional view showing a wall element and a rod according to another embodiment of the friction-generating arrangement.

Turning now to FIGS. 13 and 14, which illustrate another embodiment of the friction generating arrangement. An exercise device 50 employs an elongate rod 14 and wall element 20, for clarity only one elongate rod 14 and a pair of apertures 52 and 54 adapted to slidably receive the rod 14 will be described in conjunction with the wall element 20. It is to be understood, however, that plurality of exercise rods 14 and the corresponding number of apertures are typically associated with this embodiment.

In this embodiment the resistance to the movements of the rods and frictional forces associated therewith are resulted from the resiliency of the wall element and interaction between the resilient material of the wall of the housing and the rods. An essential feature of this embodiment (which is clearly illustrated in FIG. 14) is that the planes passing through the operational apertures 52 and 54 are tangential to the cylindrical outer surface 17 of the wall 20 of the housing. In this manner the longitudinal axis 56 which passes through the apertures 52 and 54 is positioned at an angle "A" to the vector 58 which is substantially perpendicular to the plane of the respective aperture. The apertures 52 and 54 are substantially circular and their diameter is slightly greater than diameter of the respective rod. In this condition, as illustrated in FIG. 13, the insertion of the rod 14 into both respective apertures causes deformation of the wall material. FIG. 14 illustrates a non-deformed state of the apertures 52 and 54, prior to the insertion of the rod 14 therein. During the assembly one end of the rod 14 is inserted initially into aperture 52 substantially perpendicularly to its plane. Then the rod is tilted or pivotably moved in the direction identified by the arrows "a" and "b" until its orientation along the axis 56 is achieved and the other end is inserted into the aperture 54. In this manner the rod 14 deforms the resilient material of the edges of both apertures. Such deformation is resulted in a pressure on the rod causing a friction when the rod slides through the apertures. The deformed resilient edges of the operational apertures 52 and 54 operate as a spring applying a pressure on the rod 14. The forces generated by the deformed resilient edges of the operational apertures on the rod 14 are illustrated by the arrows 51 and 53 as well as 55 and 57.

Figure 15:
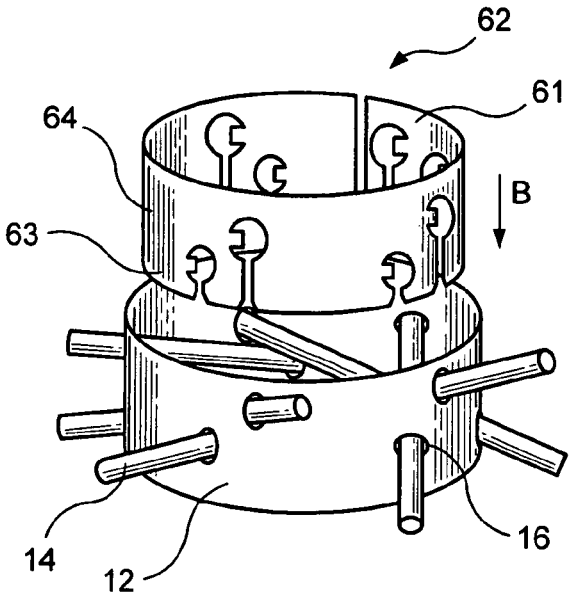
FIGS. 15, 16 and 17 illustrate a further embodiment of the friction-generating arrangement.
Figure 17:
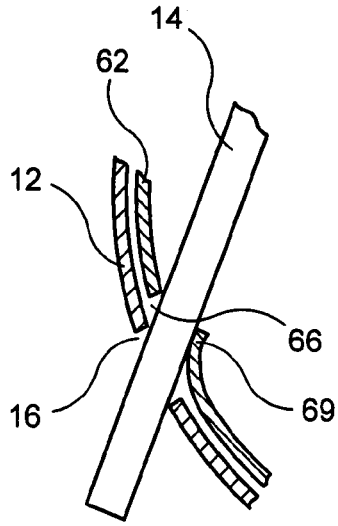
Figure 16:
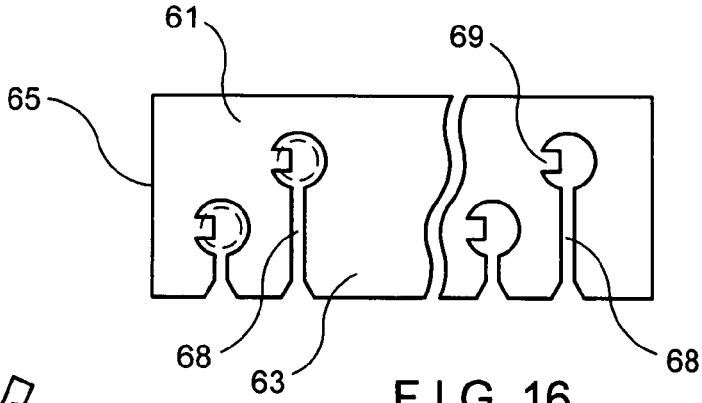

Turning now to FIGS. 15, 16 and 17 illustrating a further embodiment which utilizes conceptual principles of the invention similar to that discussed hereinabove. As in the previously described embodiments, the exercise device consists of a substantially hollow, cylindrically-shaped housing 12 formed with a plurality of operational apertures 16 adapted to slidably receive the respective elongated rods 14. An insert 62 configured to closely confirm the shape of the housing is also provided. Although, the insert can be positioned either inside or outside of the housing, the preferred version of this embodiment of the invention will be described with the insert 62 adapted to be positioned within an interior area of the housing. For the purposes of illustration, FIG. 15 depicts the insert 62 situated outside of the housing 12 prior to its insertion into the substantially hollow interior area thereof. The insert 62 is typically formed from a soft deformable plastic and consists of a substantially hollow cylindrical body 64 extending between top 61 and bottom 63 regions thereof. A plurality of openings 66 is provided within the wall of the insert 62 in the locations corresponding to the respective operational apertures 16 of the housing. To facilitate assembly of the device, each opening 66 is connected to either top 61 or bottom 63 region of the insert by a corresponding slot 68. Each opening 66 is formed with a frictional member or tongue 69 which extends inwardly from an outer periphery thereof. As illustrated in FIG. 16, during the manufacturing process the insert initially can be made in the form of a substantially flat strip 65 provided with the respective openings 66 and slots 68. During the installation, the insert 62 is moved within the interior of the housing as illustrated by an arrow "B" in FIG. 15. Location and shape of the openings 66 and slots 68 facilitate positioning of the insert 62 within the housing 12 after the rods 14 have been positioned in the corresponding operational apertures 16. The insert 62 is moved into its position within the interior of the housing 12 until each rod 14 is received within the respective slot 68 and then received within opening 66. In this manner, the respective tongues 69 are deformed, providing a resistance to the slidable movement of the rod 14 within the operational apertures 16 of the housing and the respective openings 66 of the insert. As clearly illustrated in the cross-sectional view of FIG. 17, the interlocking relationship between the respective operational apertures 16 and the openings 66 having the tongues 69 provide a resistance to the slidable motion of the rods upon use of the exercising device by an individual. It should be also noted that the rods 14 can be inserted into the device after the insert 62 is fixedly located within the housing 12.

Figure 18:
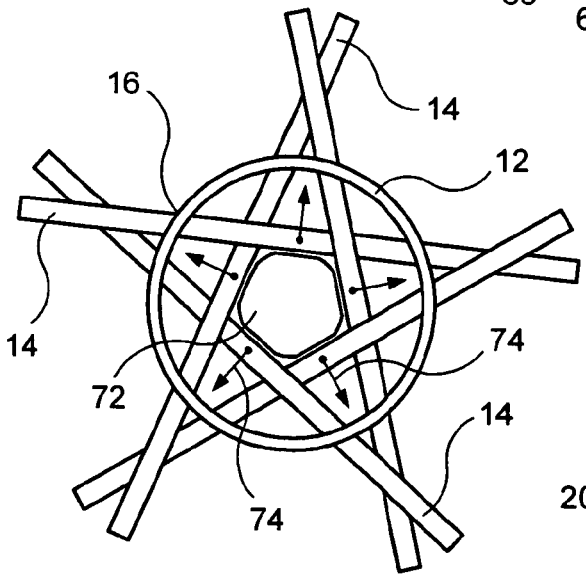
FIG. 18 is a top plan view of the device showing an embodiment of the friction-generating arrangement utilizing a resilient member.
Figure 19:
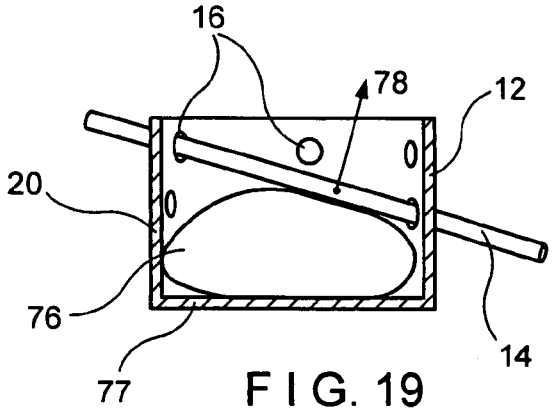
FIG. 19 is a cross-sectional view of the device showing a further embodiment of the friction-generating arrangement with a resilient member.

Turning now to FIGS. 18 and 19 illustrating a further embodiment of the invention utilizing another friction generating arrangement. As depicted in FIG. 18, an elongated resilient member 72 is adapted for insertion within the central portion of the substantially cylindrical housing 12, so as to extend along the longitudinal axis thereof. Upon being positioned within the housing, the resilient member 72 exerts radially directed pressure on the rods 14, the forces of pressure are illustrated by the arrows 74. During slidable motion of the rods 14 within the respective operational apertures 16, the pressure is resulted in the frictional forces, providing resistance to the slidable movement of the rods within the respective operational apertures. The friction occurs in areas of contact of the resilient member 72 with the rods and also in areas of contact of the rods with respective apertures. It should be noted that the forces 74 cause reactive forces at edges of the apertures. Although the centrally located cylindrically-shaped resilient member 72 is illustrated in FIG. 18, it is to be understood that the resilient member of a different configuration can be positioned within a different region of the substantially hollow inner area of the housing as long as the required pressure is exerted on the rods.

In the embodiment of FIG. 19 the resilient element 76 is positioned within the interior of the housing 12 between the bottom portion 77 and the rod 14. In this embodiment the resilient element 76 exerts pressure on the rod 14 in such a manner that the longitudinally directed force (illustrated by the arrow 78) acts on the rod 14, and ultimately resulted in resistance to the slidable motion thereof within the respective operational aperture 16. For clarity, only one rod 14 is illustrated in FIG. 19.

Figure 20:
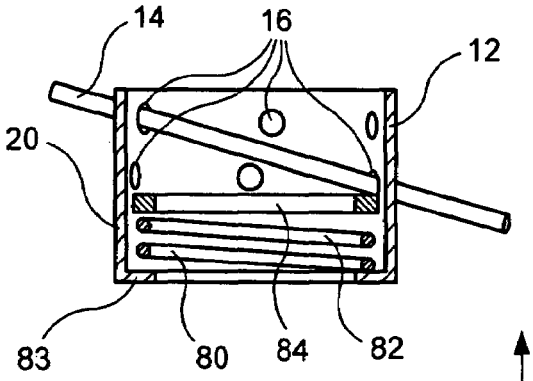
FIG. 20 is a cross-sectional view of the device using the friction-generating arrangement with a biasing element.

FIG. 20 illustrates the embodiments of the invention with another friction-generating arrangement utilizing a biasing element 80 in the form of a spring 82 extending longitudinally within the substantially hollow area of the housing 12 and supported by the bottom portion 83. As shown in FIG. 20, an outer periphery of the biasing element or spring 82 is positioned in a close vicinity of the inner surface of the housing and an engaging element 84 is interposed between the rod 14 and the biasing element. The engaging element 84 is in the form of a ring or disc. Thus, the longitudinally directed pressure is transferred from the biasing element 80 to the central area of the rod 14 by means of the engaging element 84. The pressure exerted on the rod 14 is also directed at the area of engagement between the rod 14 and the respective operational aperture 16, thereby providing the required resistance to the slidable motion thereof. Another source of resistance is area of contact between the rod 14 and the engaging element 84. For clarity, only one rod is illustrated in FIG. 20. Normally, multiple rods are received by the respective apertures 16, so that the engaging element 84 exerts pressure on all rods in the area close to the wall 20. A spherical or cone-shaped engaging elements which exerts pressure on the rods in the area close to longitudinal axis of the housing are also contemplated. It is to be understood that different locations of biasing and engagement elements are also within the scope of the invention.

Figure 21:
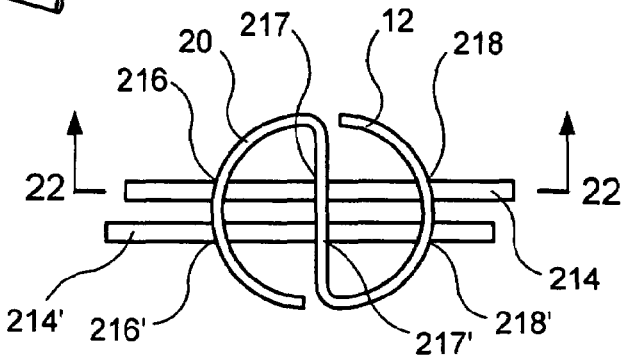
FIG. 21 is a top plan view showing a wall element of an S-shaped cross section.
Figure 22:
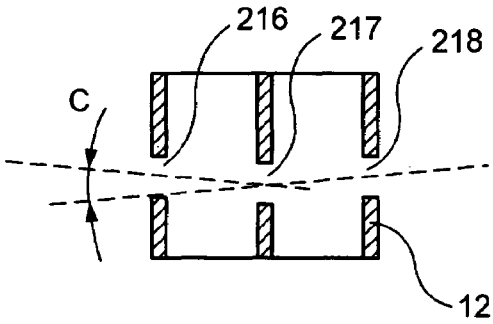
FIG. 22 is a cross-sectional view taken along section line 22-22 of FIG. 21, without the rod being positioned in the apertures.
Figure 23:
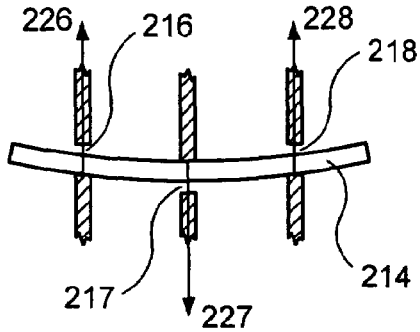
FIG. 23 is a schematic diagram of forces applied to the rods of FIG. 21.
Figure 24:
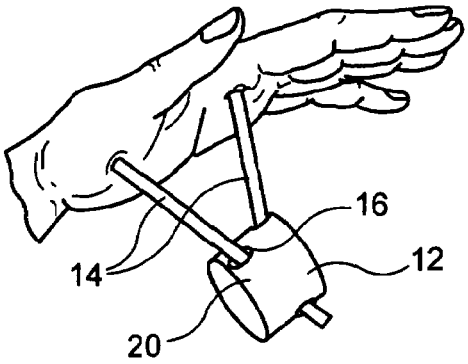
FIGS. 24 and 25 illustrate therapeutic application of the invention to a palm of a user.
Figure 25:
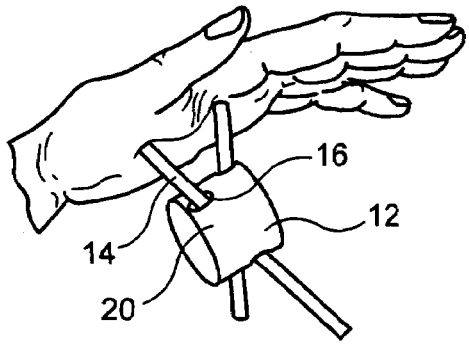
Figure 32:
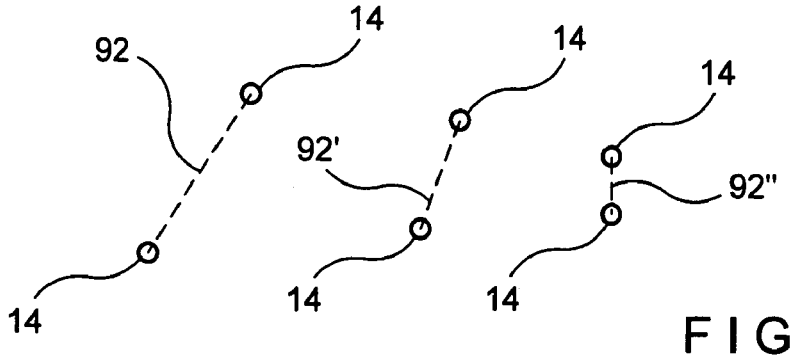
FIG. 32 is a top view schematically illustrating intermediate positions of tips of two rods shown in FIGS. 24 and 25.

A further friction generating arrangement providing resistance to slidable movement of the rods is illustrated in FIGS. 21, 22 and 23. Turning now to FIG. 21 illustrating a wall 20 of a housing 12 having an S-shape configuration. Two cylindrical rods 214 and 214' are slidably received within the three respective apertures. In this respect the rod 214 passes through apertures 216, 217, 218 and rod 214' passes trough apertures 216', 217', 218'. Turning now to FIG. 22 where relative location of tree apertures adapted to slidably receive each rod is illustrated schematically. There is a small angle "C" between two imaginary lines shown in FIG. 22. One such imaginary line passes through centers of apertures 216 and 217, and another line passes through centers of apertures 217 and 218. In this manner the rod 214 supported by apertures 216, 217 and 218 is slightly elastically deformed by the edges of supporting apertures. Forces applied to the rod 214 are illustrated schematically in FIG. 23 by arrows 226, 227 and 228. These forces are resulted in friction in areas of contact between the rod with the respective apertures, so as to provide resistance to the slidable motion of the rod through the apertures. Similarly, friction is generated when the rod 214' slides trough apertures 216', 217' and 218'. It is to be understood that configuration of the wall element, location of the apertures and number of rods and shape of their cross-section can vary as long as for the frictional forces are generated for each rod in the manner described hereinabove.

It is to be understood that means that provide resistance to slidable movement of the rods disclosed hereinabove can be used separately or in combination with each other. It should also be understood also that any other suitable means could be used for the same purpose.

Figure 4:
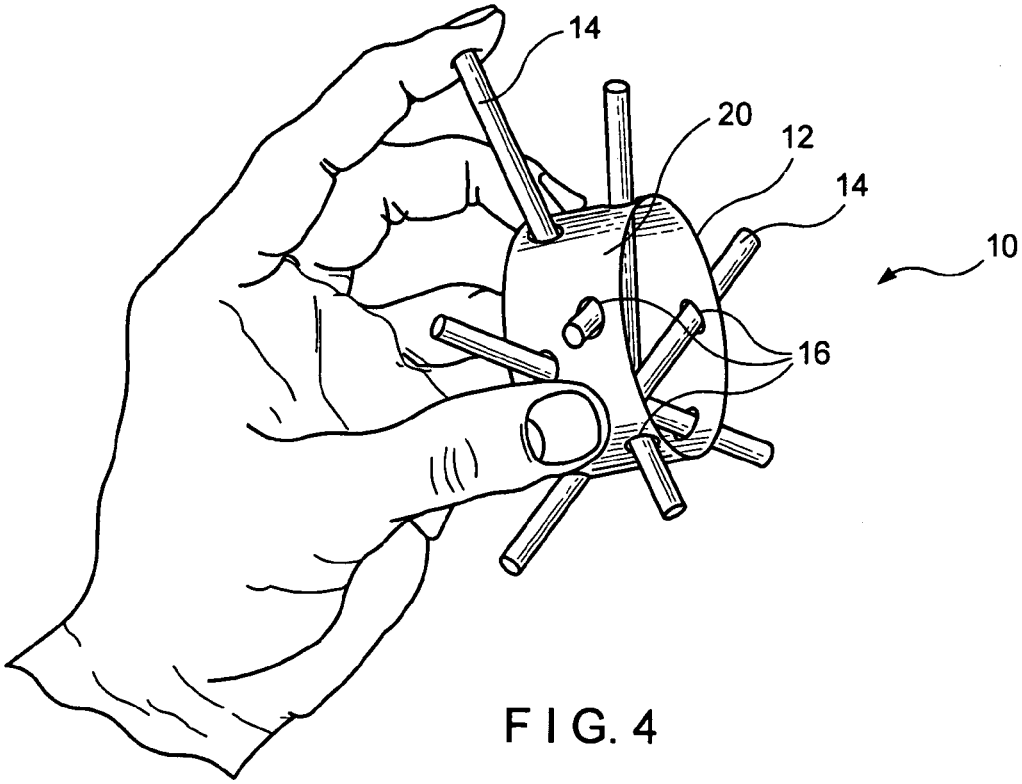
FIG. 4 illustrates positioning of the device in the hand of a user.

One example of the use of the device of the invention for the exercising purposes is illustrated in FIG. 4. As user grasps the housing 12 with thumb, middle and forth fingers of one hand the respective rod 14 which is in its extended condition is pushed by the index finger, so as to achieve a contracted position thereof in which the end portion of the rod is close to the housing. Obviously this movement causes extension of the rod on the opposite side of the housing. Once the desired amount of movement of the respective rods is achieved, the position of the fingers and thumb may be changed to push the next rod. Instead of using the thumb and fingers for controlling movement of the rods, areas of the hand, such as the palm, in combination with the thumb or one or more fingers can be used, depending on the type of exercise desired. In addition, the housing 12 may be held in one hand while the rods are pushed by the other hand and moved toward the one hand to thereby exercise the muscles associated with the hand, wrist, and arms.

Further to the benefits derived from using the exercise device of the invention, such as increased strength and mobility in the hand and fingers, motivation to exercise may be enhanced by intellectual stimulation which is also resulted in stress relief. For example, a user determines which rods must be inserted into which pairs of apertures, so as to achieve their exposure on one side of the housing and in which order the rods should be inserted through different pairs of apertures in the housing 12 without significant interference from other rods, so as to achieve for example a star-type formation by the rods.

On another hand, areas around each aperture may be painted in different colors so that each color indicates a pair of apertures to support a rod. For example, five colors may be used for the rod formation shown in FIGS. 1, 2 and 3. This may be necessary to provide a user with a guide to assemble the device.

In addition to the exercising and stress relief function, the device of the invention is also capable of providing a user with therapeutic or massaging capabilities. This is especially so when the ends of the rods are applied in a therapeutic manner to different parts of a human body. An example of the massaging or therapeutic application of the device of the invention to a palm of the user is being discussed herein below. As best illustrated in FIGS. 2 and 5, the device of the invention provides the star-like arrangement by the ends of pairs of adjacent rods which are uniformly dispersed along the outer periphery of the housing. Referring now to FIGS. 24-32, illustrating the therapeutic application of the device of the invention. As pressure is applied by a palm of the user against the extended ends, the rods 14 are being slided within the corresponding apertures 16 (see FIGS. 24 and 25) in the manner described hereinabove. In view of the resistance to such slidable movement provided by the device, the engagement between the ends of the rods and the palm of the user resulted in therapeutic qualities which cause among other qualities stress dissipation in the respective areas of the palm. This occurs while the rods 14 are advanced in their slidable motion. In addition to the applied pressure, a slight pinch and deformation of skin occurred in the part of the palm engaging the rods. The pinch and skin deformation is mainly a result of the non-parallel orientation of the pairs of the rods 14 as illustrated in FIGS. 26-32. For clarity, only one pair of the rods 14 is illustrated in these figures.

Initially, when the fully extended rods 14 are applied against the skin of the user (see FIGS. 24, 26-28.), the distance between the ends of the rods, identified as $D_{extended}$ (see FIG. 28) is greater than the distance $D_{contracted}$ between these ends of the rods at their location near the wall of the housing at the end of their slidable journey (see FIGS. 25, 29-31). It is clearly illustrated in FIG. 32 that the distance between the ends or tips of the rods 14 is progressively reduced during the slidable motion thereof from the fully extended to a contracted or submerged position. The imaginary line 92 (see FIG. 32) depicting the distance between the ends of the rods is reduced and also the line is slightly rotated while the rods 14 are advanced in their slidable motion. This gradual reduction of the distance 92 between the ends of the rods 14 and the rotation is resulted in a slight pinch and deformation of an area of the skin situated there between. It is to be understood that therapeutic application of the device of the invention will occur when it is applied to the parts of the body other than palm.

Figure 33:
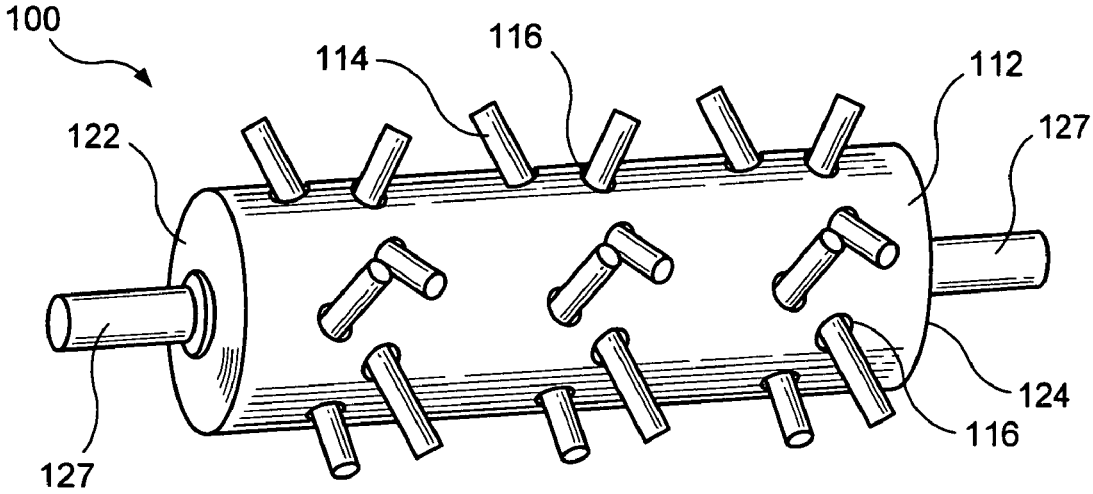
FIG. 33 is a perspective view of the massaging device of the invention.
Figure 34:
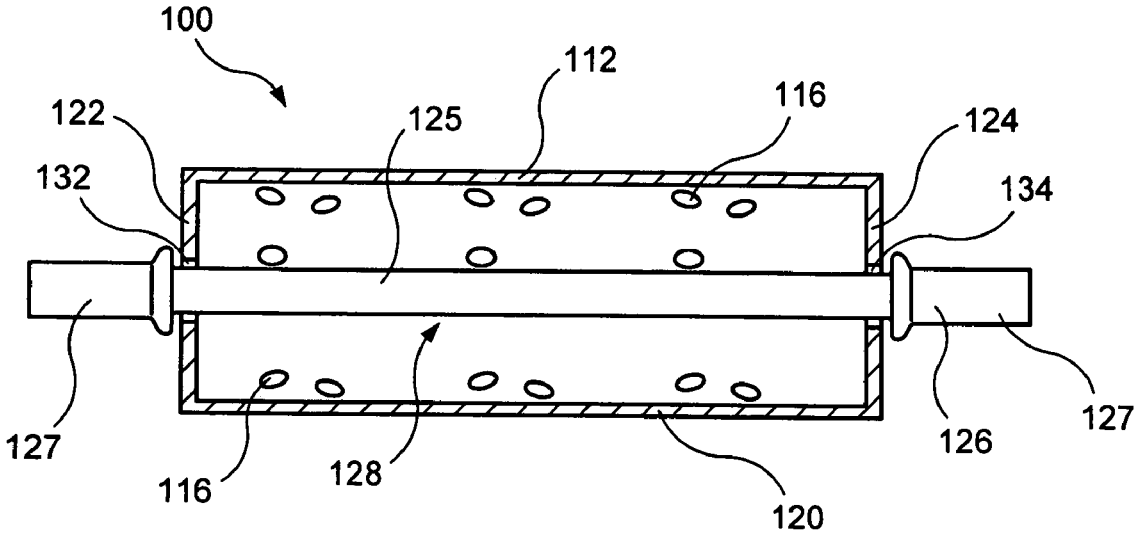
FIG. 34 is a partial cross-sectional view of the device shown in FIG. 33.

Referring now to FIGS. 33 and 34 illustrating a modified version of the massaging device 100 of the invention. A substantially hollow housing 112 is formed by a substantially cylindrical outer wall 120 which extends between two side walls 122 and 124. A shaft 126 extends longitudinally within the hollow interior space 128 passing through the openings 132 and 134 in the side walls 122, 124. The shaft 126 consists of a central region 125 located within the hollow interior space 128 of the housing and two outer regions or handles 127 extending outwardly there from and adapted to be conveniently positioned within the hands of an operator. A multiplicity of operational apertures 116 are formed within the substantially cylindrical wall 120, so as to receive the respective rods 114 adapted for slidable motion in the manner described hereinabove. In use an operator while holding the handles 127 by both hands rotationally apply tips of the rods 114 against the skin of the user. In view of the substantial length of the housing 112, the massaging area of the device typically covers a greater area of the body and generates an enhanced massaging effect compared to the embodiments discussed hereinabove.

While the invention has been taught with specific reference to the above-described embodiments, those skilled in the art will recognize that changes can be made in form and detail without departing from the spirit and the scope of the invention. Thus, the described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A handheld exercise and massage device, comprising:

a housing defined by at least a wall portion having an exterior area and a substantially hollow inner space, said housing formed with at least two pairs of apertures, at least two elongated rods, each said rod extending between opposite ends thereof, said ends being adapted for engagement with a hand of a user, each said rod is slidably movable within the respective pairs of apertures formed within said wall portion; and a friction generating arrangement operationally associated with the housing and comprising a biasing member extending longitudinally within the housing, said biasing member adapted to exert transverse pressure on said at least two elongated rods, so as to resist slidable movement of the rods when longitudinal pressure is applied on said ends by said hand, so as to provide a massage and exercise function for said hand and fingers.

2. An exercise device according to claim 1, wherein the friction generating arrangement is in the form of a resilient member interposed between the housing and the at least two elongated rods.

3. An exercise device according to claim 2, wherein said resilient member is positioned at a bottom portion of the housing.

4. An exercise device according to claim 1, wherein the friction generating arrangement further comprises:

an elongated, resilient friction generating member longitudinally extending within the housing so as to engage and exert pressure on said at least two elongate rods and to provide resistance to slidable movement of the rods within the respective apertures.

5. An exercise device according to claim 4, wherein said elongated resilient friction generating member extends longitudinally within a central area of the housing so that an exterior area of said member faces said at least two elongated rods.

6. An exercise device according to claim 1 wherein an engaging member is interposed between the biasing member and the at least two elongated rods.

7. A handheld exercise and massage device, comprising:

a housing defined by at least a wall portion having an exterior area and a substantially hollow inner space, said housing formed with at least two pairs of apertures, at least two elongated rods, each said rod extending between opposite ends thereof, said ends being adapted for engagement with a hand of a user, each said rod is slidably movable within the respective pairs of apertures formed within said wall portion; and a friction generating arrangement comprising:

an insert operationally associated with the housing and adapted to provide resistance to slidable movement of said at least two elongated rods, said insert is formed with at least two pairs of openings corresponding to said at least two pairs of apertures, said insert exerting pressure on said at least two elongated rods, so as to resist slidable movement of the rods when longitudinal pressure is applied on said ends by said hand and to provide a massage and exercise function for said hand and fingers.

8. An exercise device according to claim 7, wherein the at least two pairs of apertures comprise a plurality of apertures formed within the housing, the at least two elongate rods comprise a plurality of rods, the at least two pairs of openings comprise a plurality of openings formed within the insert, so that the plurality of openings corresponds to the plurality of apertures of the housing, each said rod is adapted for slidable movement through the respective apertures and openings.

9. An exercise device according to claim 8, wherein each said opening is formed with a frictional member extending toward a central area thereof so as to provide additional resistance to the slidable movement of the rods.

10. An exercise device according to claim 8, further comprising a plurality of slots extending between each said opening and one of top or bottom regions of the insert.

11. An exercise device according to claim 7, wherein said insert is defined by at least an exterior surface facing an interior area of said housing.

12. An exercise device according to claim 11, wherein a slot extends outwardly from each said opening in the insert, each said slot is adapted for engagement with the respective elongated rod.

* * * * *